US009705220B2

(12) United States Patent
Yokoyama

(10) Patent No.: US 9,705,220 B2
(45) Date of Patent: Jul. 11, 2017

(54) CONNECTOR AND CONNECTOR ASSEMBLY

(71) Applicant: Japan Aviation Electronics Industry, Limited, Tokyo (JP)

(72) Inventor: Yohei Yokoyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/307,093

(22) PCT Filed: Mar. 31, 2015

(86) PCT No.: PCT/JP2015/060081

§ 371 (c)(1),
(2) Date: Oct. 27, 2016

(87) PCT Pub. No.: WO2015/170529

PCT Pub. Date: Nov. 12, 2015

(65) Prior Publication Data

US 2017/0047676 A1 Feb. 16, 2017

(30) Foreign Application Priority Data

May 8, 2014 (JP) ..... 2014-097041

(51) Int. Cl.
*H01R 12/00* (2006.01)
*H01R 12/73* (2011.01)
*H01R 13/6582* (2011.01)

(52) U.S. Cl.
CPC ..... *H01R 12/73* (2013.01); *H01R 13/6582* (2013.01)

(58) Field of Classification Search
CPC ..... H01R 12/73; H01R 12/692; H01R 12/79; H01R 12/774; H01R 12/88; H01R 12/771; H01R 13/6582
(Continued)

(56) References Cited

U.S. PATENT DOCUMENTS 7,172,446 B1 * 2/2007 Hashimoto ..... H01R 12/774 439/260
7,223,121 B2 5/2007 Moriyama et al.
(Continued)

FOREIGN PATENT DOCUMENTS

JP H04-102587 U 9/1992
JP 2005-063784 A 3/2005
(Continued)

OTHER PUBLICATIONS

International Search Report of PCT/JP2015/060081, mailed Jun. 9, 2015.

*Primary Examiner* — Jean F Duverne
(74) *Attorney, Agent, or Firm* — Collard & Roe, P.C.

(57) ABSTRACT

A connector mateable with a mating connector along a predetermined direction. The mating connector comprises a ground member and a mating signal terminal. The ground member has a ground contacted portion and a locked portion. The connector comprises a first portion, a second portion and a signal terminal. The first portion has a lock portion and a lock spring portion. The lock portion is brought into contact with the ground contacted portion in a process where the connector and the mating connector are mated with each other. The lock portion locks the locked portion under a state where the connector is mated with the mating connector. The signal terminal has a signal contact portion. The signal contact portion is to be brought into contact with the mating signal terminal.

9 Claims, 8 Drawing Sheets

(58) Field of Classification Search
USPC ..... 439/65
See application file for complete search history.

(56) References Cited

U.S. PATENT DOCUMENTS

| | | | | |
|---|---|---|---|---|
| 7,255,586 | B2 | 8/2007 | Okada | |
| 7,275,948 | B2 | 10/2007 | Miura et al. | |
| 7,438,595 | B2 | 10/2008 | Saito | |
| 2002/0115327 | A1* | 8/2002 | Yamane | H01R 12/88 439/260 |
| 2005/0118849 | A1* | 6/2005 | Okita | H01R 12/88 439/260 |
| 2006/0089036 | A1* | 4/2006 | Takai | H01R 12/771 439/260 |
| 2006/0286843 | A1* | 12/2006 | Fukazawa | H01R 12/88 439/260 |
| 2007/0054545 | A1* | 3/2007 | Takahira | H01R 12/79 439/495 |
| 2007/0066127 | A1* | 3/2007 | Inoue | H01R 12/79 439/495 |
| 2007/0087605 | A1* | 4/2007 | Suzuki | H01R 12/592 439/260 |

FOREIGN PATENT DOCUMENTS

| | | | |
|---|---|---|---|
| JP | 2006-236657 | A | 9/2006 |
| JP | 2007-012588 | A | 1/2007 |
| JP | 2007-103249 | A | 4/2007 |
| JP | 2007-165212 | A | 6/2007 |
| JP | 2011-023236 | A | 2/2011 |

* cited by examiner

CONNECTOR AND CONNECTOR ASSEMBLY

CROSS REFERENCE TO RELATED APPLICATIONS

This application is the National Stage of PCT/JP2015/060081 filed on Mar. 31, 2015, which claims priority under 35 U.S.C. §119 of Japanese Application No. 2014-097041 filed on May 8, 2014, the disclosure of which is incorporated by reference. The international application under PCT article 21(2) was not published in English.

TECHNICAL FIELD

This invention relates to a connector assembly having a frictional locking mechanism, and to a connector constituting the connector assembly.

BACKGROUND ART

For example, Patent Document 1 discloses a connector assembly 900 having a frictional locking mechanism. As shown in FIG. 16, the connector assembly 900 of Patent Document 1 consists of a connector 910 and a mating connector 950. The connector 910 comprises signal terminals 911, a holding member 912 and a shell 920. The holding member 912 holds the signal terminals 911. The shell 920 partially covers the holding member 912. The shell 920 is formed with lock portions 921 and lock spring portions 922. The lock spring portions 922 support the lock portions 921, respectively. The mating connector 950 comprises mating signal terminals 951, a mating holding member 952 and a mating shell 953. The mating holding portion 952 holds the mating signal terminals 951. The mating shell 953 partially covers the mating holding member 952. The mating shell 953 is provided with locked portions 954. Under a state where the connector 910 is mated with the mating connector 950, the lock portions 921 lock the locked portions 954, respectively. Accordingly, the mated state of the connector 910 with the mating connector 950 is maintained.

PRIOR ART DOCUMENTS

Patent Document(s)

Patent Document 1: JPA 2007-103249

SUMMARY OF INVENTION

Technical Problem

It is an object of the present invention to further improve resistance to EMI (Electromagnetic interference) in a connector assembly having a frictional locking mechanism.

Solution to Problem

An aspect of the present invention provides a connector mateable with a mating connector along a predetermined direction. The mating connector has a mating fitting end. The mating fitting end is positioned at an end of the mating connector in the predetermined direction. The mating connector comprises a ground member and a mating signal terminal. The ground member has a ground contacted portion and a locked portion. The ground contacted portion is positioned between the locked portion and the mating fitting end in the predetermined direction. The connector has a fitting end. The fitting end is positioned at an end of the connector in the predetermined direction. The connector comprises a first portion, a second portion and a signal terminal. The first portion has a lock portion and a lock spring portion. The lock spring portion resiliently supports the lock portion. The lock portion is brought into contact with the ground contacted portion in a process where the connector and the mating connector are mated with each other. The lock portion locks the locked portion under a state where the connector is mated with the mating connector. The second portion is at least electrically connected with the first portion. The second portion has a ground contact portion and a ground spring portion. The ground spring portion resiliently supports the ground contact portion. The ground contact portion is brought into contact with the ground contacted portion under the state where the connector is mated with the mating connector. The lock portion is positioned between the fitting end and the ground contact portion in the predetermined direction. The signal terminal has a signal contact portion. The signal contact portion is to be brought into contact with the mating signal terminal.

Advantageous Effects of Invention

The lock portion according to the present invention is brought into contact with the ground contacted portion in the process where the connector and the mating connector are mated with each other. The ground contact portion according to the present invention is brought into contact with the ground contacted portion under the state where the connector is mated with the mating connector. Accordingly, the ground contacted portion according to the present invention is continuously connected to the ground in the process where the connector and the mating connector are mated with each other. Thus, the connector assembly according to the present invention has a high resistance to EMI.

Since the lock portion according to the present invention is positioned at a position different from that of the ground contact portion in the predetermined direction, a contact position at which the ground contact portion and the ground contacted portion are brought into contact with each other is near to the mating fitting end under the state where the connector is mated with the mating connector. Accordingly, an appropriate grounding path can be established therebetween.

The mating signal terminal according to the present invention is spaced apart from the mating fitting end in the predetermined direction by a first distance. The ground contacted portion according to the present invention is spaced apart from the mating fitting end in the predetermined direction by a second distance. The first distance is shorter than the second distance by a first predetermined distance. In addition, the signal contact portion of the present invention is spaced apart from the fitting end in the predetermined direction by a third distance. The lock portion of the present invention is spaced apart from the fitting end in the predetermine direction by a fourth distance. The third distance is longer than the fourth distance by a second predetermined distance. The second predetermined distance is longer than the first predetermined distance. Thus, according to the present invention, in the process where the connector and the mating connector are mated with each other, the lock portion is connected with the ground contacted portion before the signal terminal is connected with the mating signal terminal. Accordingly, a satisfactory connection sequence can be achieved in the connector assembly according to the present invention.

An appreciation of the objectives of the present invention and a more complete understanding of its structure may be had by studying the following description of the preferred embodiment and by referring to the accompanying drawings.

DESCRIPTION OF EMBODIMENTS

Figure 1:
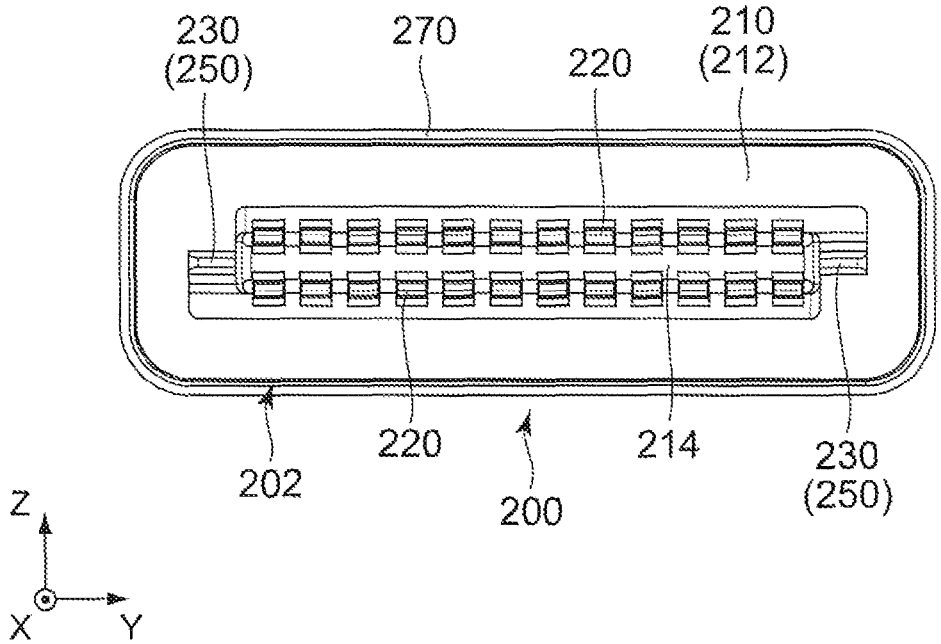
FIG. 1 is a front view showing a receptacle according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIGS. 1, 2, 7, 8 and 12, a connector assembly 10 according to an embodiment of the present invention comprises a plug (connector) 100 and a receptacle (mating connector) 200. As understood from FIGS. 12 to 15, the plug 100 is mateable with the receptacle 200 along an X-direction (predetermined direction).

Figure 2:
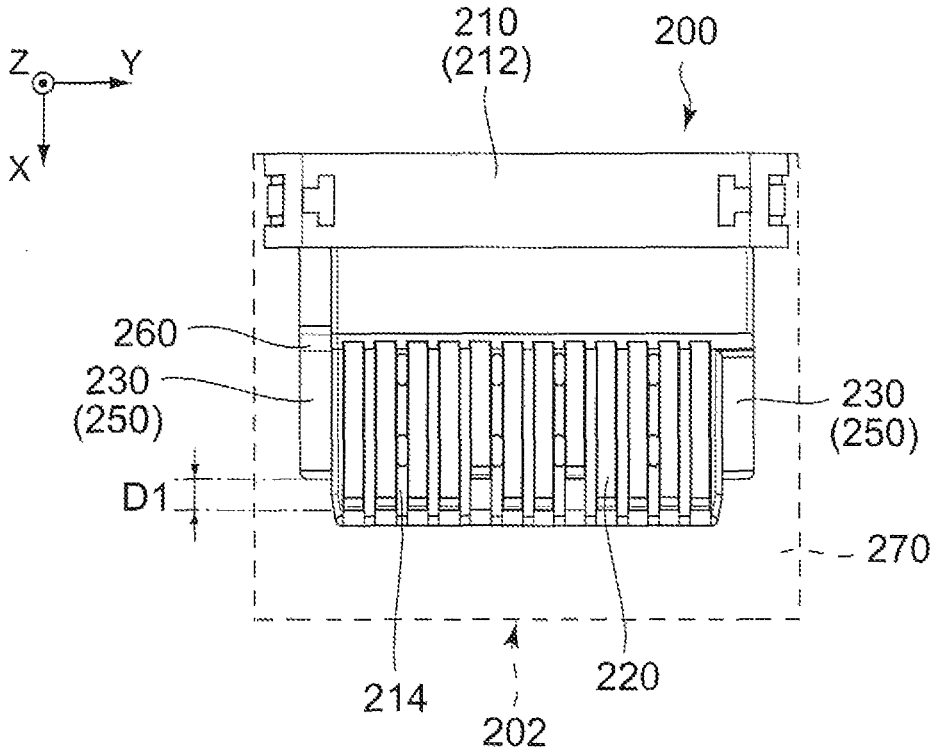
FIG. 2 is a top view showing the receptacle of FIG. 1. A receptacle shell of the receptacle is illustrated by dotted line.

As shown in FIGS. 1 and 2, the receptacle 200 comprises a receptacle holding member (mating holding member) 210, a plurality of receptacle signal terminals (mating signal terminals) 220, a ground member 230 and a receptacle shell 270. The receptacle holding member 210 is made of insulator such as resin. Each of the receptacle signal terminals 220 is made of conductor. The ground member 230 is made of metal. The receptacle shell 270 is made of metal. The receptacle signal terminals 220 and the ground member 230 are substantially held by the receptacle holding member 210. The receptacle holding member 210 is partially covered by the receptacle shell 270.

As shown in FIGS. 2 to 5, the receptacle holding member 210 has a base portion 212 and a plate portion 214. The plate portion 214 protrudes from the base portion 212 in a positive X-direction. The receptacle shell 270 is attached to the base portion 212. The receptacle shell 270 covers the whole of the plate portion 214. The plate portion 214 has two principal surfaces (upper surface and lower surface) in a Z-direction (perpendicular direction). The plate portion 214 of the present embodiment has a thicker part and a thinner part, and the thicker part is nearer to the base portion 212 than the thinner part is. However, the present invention is not limited thereto. For example, the plate portion 214 may have a substantially constant thickness.

Figure 3:
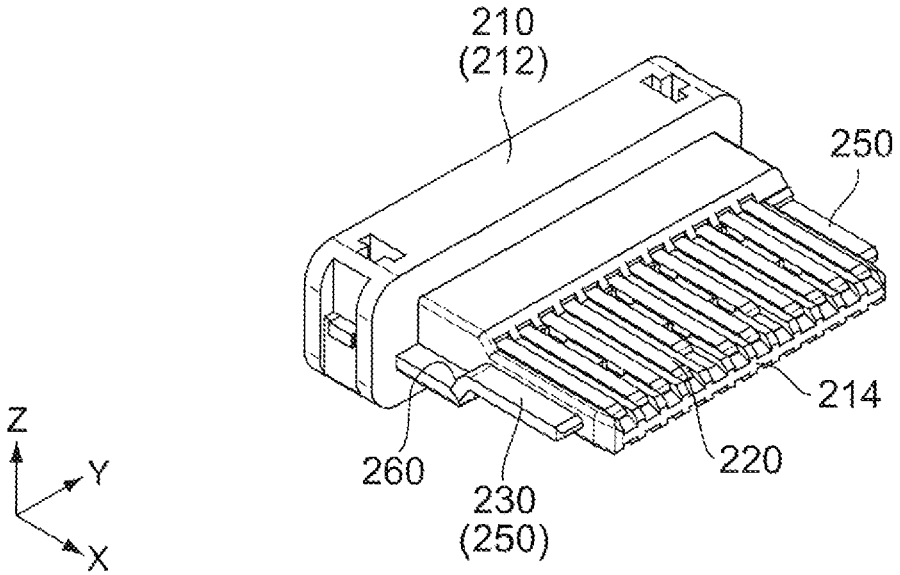
FIG. 3 is an upper perspective view showing a structure consisting of components other than the receptacle shell among components of the receptacle of FIG. 1.
Figure 4:
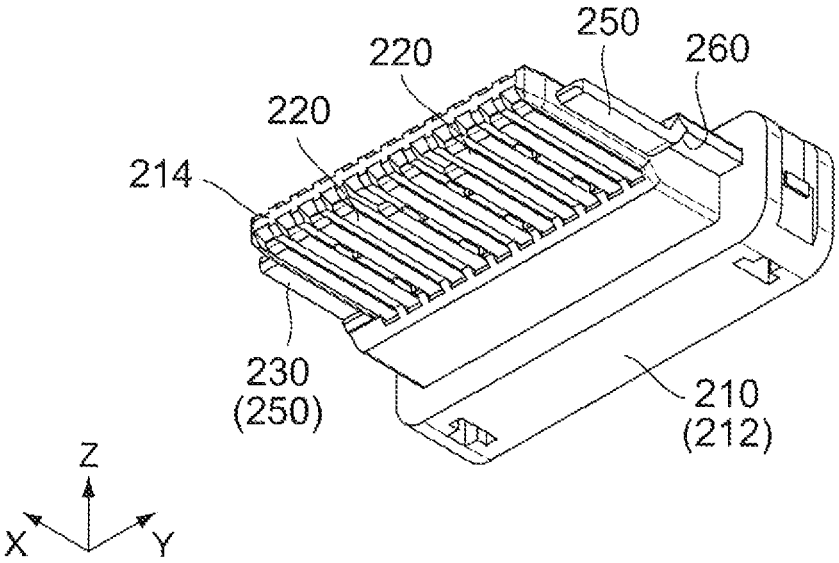
FIG. 4 is a lower perspective view showing the structure of FIG. 3.
Figure 5:
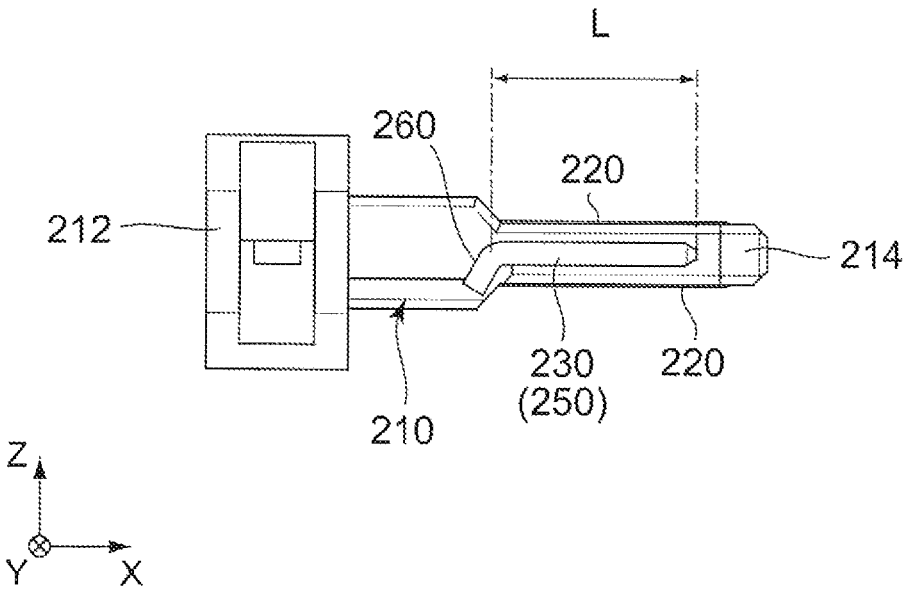
FIG. 5 is a side view showing the structure of FIG. 3.

As understood from FIG. 1, the receptacle signal terminals 220 are separated into two rows. The receptacle signal terminals 220 of each row are arranged in a Y-direction (pitch direction) The receptacle signal terminals 220 of one of the rows are disposed away from the receptacle signal terminals 220 of a remaining one of the rows in the Z-direction. In detail, as shown in FIGS. 2, 3 and 5, the receptacle signal terminals 220 of one of the rows are exposed on a positive Z-side of the plate portion 214. In addition, as shown in FIGS. 4 and 5, the receptacle signal terminals 220 of a remaining one of the rows are exposed on a negative Z-side of the plate portion 214.

Figure 6:
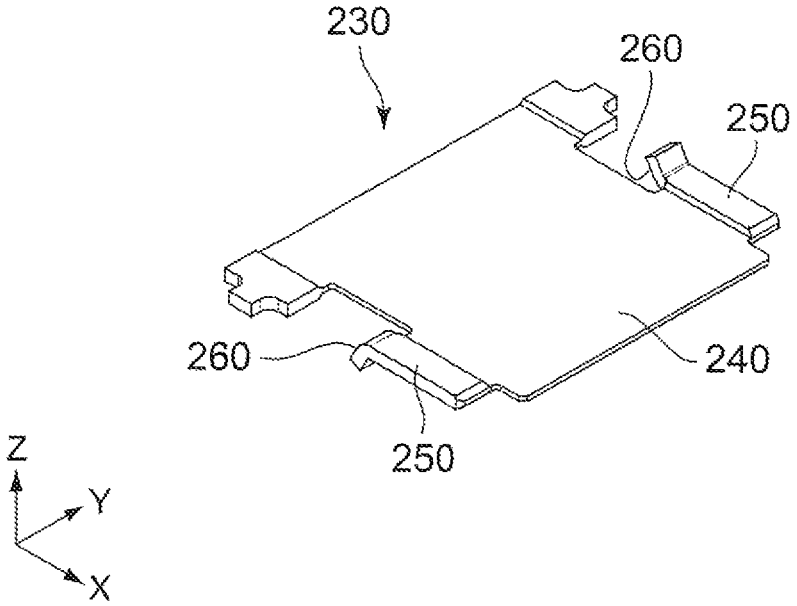
FIG. 6 is a perspective view showing a ground member which is included in the structure of FIG. 3.

As shown in FIG. 6, the ground member 230 has a ground main portion 240 having a plate-like shape, two ground contacted portions 250 and two locked portions 260.

The ground main portion 240 is a portion which is used as a so-called ground plate. Each of the ground contacted portions 250 has a strip-like shape which extends along the X-direction. Each of the ground contacted portions 250 extends outward from the ground main portion 240 in the Y-direction. In addition, each of the ground contacted portions 250 is positioned in the vicinity of a positive X-side end of the ground main portion 240. In detail, in a case where the ground main portion 240 is divided into two parts of a positive X-side part thereof (positive X portion) and a negative X-side part thereof (negative X portion), the whole of each of the ground contacted portions 250 extends outward in the Y-direction from the positive X portion of the ground main portion 240. As shown in FIG. 5, each of the ground contacted portions 250 has a length L in the X-direction.

Figure 12:
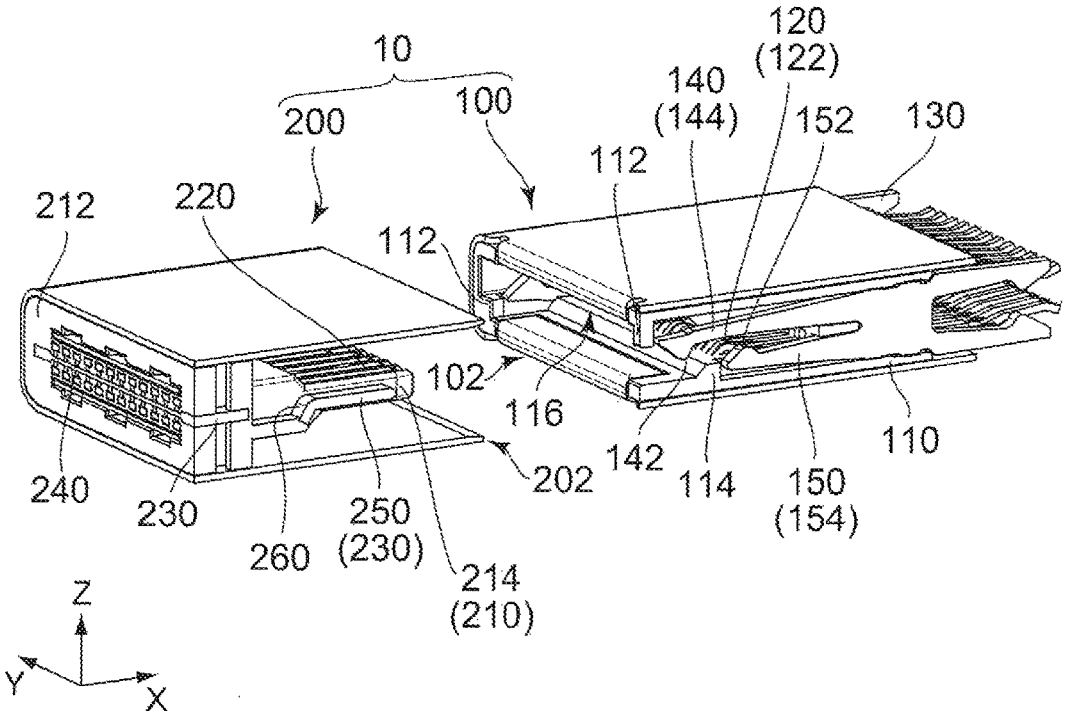
FIG. 12 is a cross-sectional, perspective view showing a state in a mating process of a connector assembly according to the present embodiment.

As shown in FIG. 6, the locked portions 260 are provided so as to correspond to the ground contacted portions 250, respectively. Each of the locked portions 260 is positioned at a negative X-side of the corresponding ground contacted portion 250. Specifically, as shown in FIG. 12, each of the ground contacted portions 250 is positioned between the corresponding locked portion 260 and a receptacle fitting end (mating fitting end) 202 which is positioned at an end of the receptacle 200 in the X-direction. Each of the locked portions 260 extends in a direction intersecting with the X-direction from a negative X-side end of the corresponding ground contacted portion 250. In detail, as shown in FIG. 6, the locked portion 260, which is positioned at a positive Y-side of the ground member 230, extends from the corresponding ground contacted portion 250 in both a negative X-direction and a positive Z-direction, and the locked portion 260, which is positioned at a negative Y-side of the ground member 230, extends from the corresponding ground contacted portion 250 in both the negative X-direction and a negative Z-direction. In other words, the locked portions 260 extend in orientations different from each other in the Z-direction.

As shown in FIGS. 1 to 5, the ground contacted portions 250 and the locked portions 260 of the ground member 230 are positioned at opposite sides, respectively, of the plate portion 214 in the Y-direction. Meanwhile, as understood from FIGS. 1 to 6 and 12, the ground main portion 240 of the ground member 230 is embedded in the receptacle holding member 210. Specifically, about one-fourth part of the ground main portion 240 is held by the base portion 212, and a remaining, about three-fourth part thereof is held by the plate portion 214. In the plate portion 214, the ground main portion 240 is positioned between the two rows of the receptacle signal terminals 220. In the plate portion 214, the ground main portion 240 is positioned apart from each of the rows of the receptacle signal terminals 220. In other words, the ground main portion 240 is insulated from the receptacle signal terminals 220 in the plate portion 214. Since the ground main portion 240 is interposed between the two rows of the receptacle signal terminals 220, crosstalk between the two rows can be prevented from occurring.

As shown in FIG. 2, in the X-direction, an end of each of the receptacle signal terminals 220 is positioned beyond an end of each of the ground contacted portions 250 in the positive X-direction. Specifically, the end of each of the receptacle signal terminals 220 is nearer to the receptacle fitting end 202 than the end of each of the ground contacted portions 250 is, and the end of each of the receptacle signal terminals 220 is positioned between the end of each of the ground contacted portions 250 and the receptacle fitting end 202. Specifically, each of the receptacle signal terminals 220 is spaced part from the receptacle fitting end 202 in the X-direction by a first distance. Each of the ground contacted portions 250 is spaced apart from the receptacle fitting end 202 in the X-direction by a second distance. The first distance is shorter than the second distance by a first predetermined distance D1.

Figure 7:
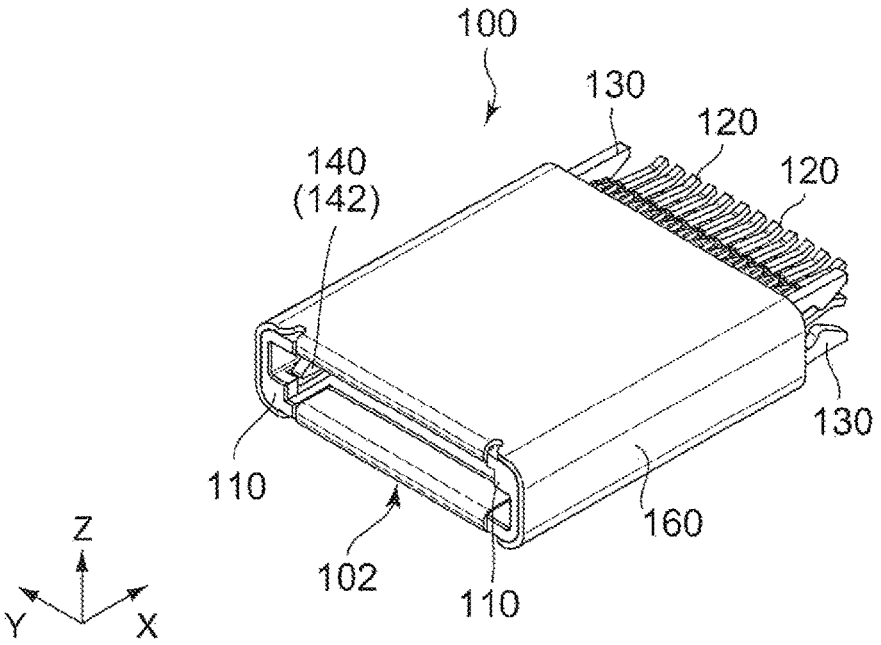
FIG. 7 is a perspective view showing a plug according to an embodiment of the present invention.
Figure 8:
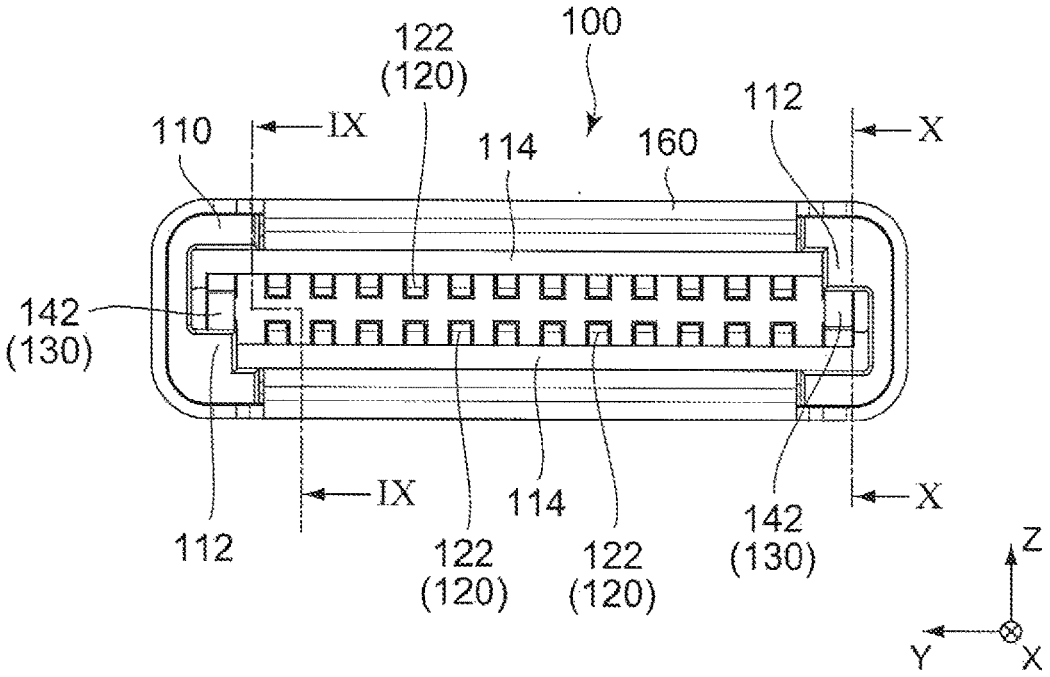
FIG. 8 is a front view showing the plug of FIG. 7.
Figure 9:
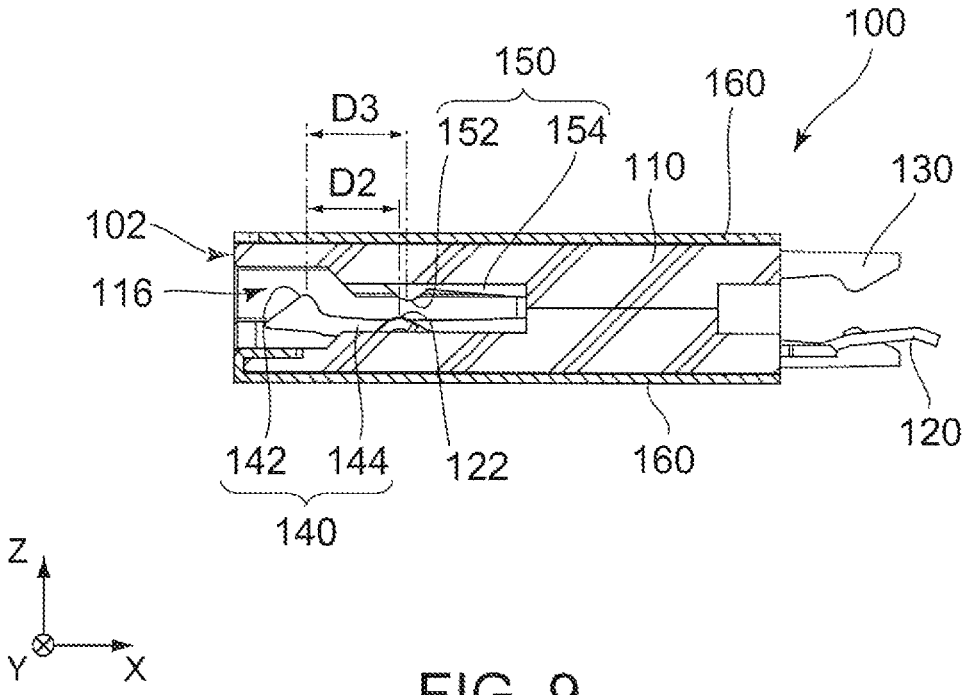
FIG. 9 is a cross-sectional view showing the plug of FIG. 8, taken along line IX-IX.

As shown in FIGS. 7 to 9, the plug 100 comprises a plug holding member (holding member) 110, a plurality of plug signal terminals (signal terminals) 120, two ground terminals 130 and a plug shell 160. The plug holding member 110 is made of insulating material such as resin. Each of the plug signal terminals 120 is made of conducting material. Each of the ground terminals 130 is made of metal. The plug shell 160 is made of metal. The plug signal terminals 120 and the ground terminals 130 are substantially held by the plug holding member 110. The whole of the plug holding member 110 is substantially covered by the plug shell 160.

Figure 10:
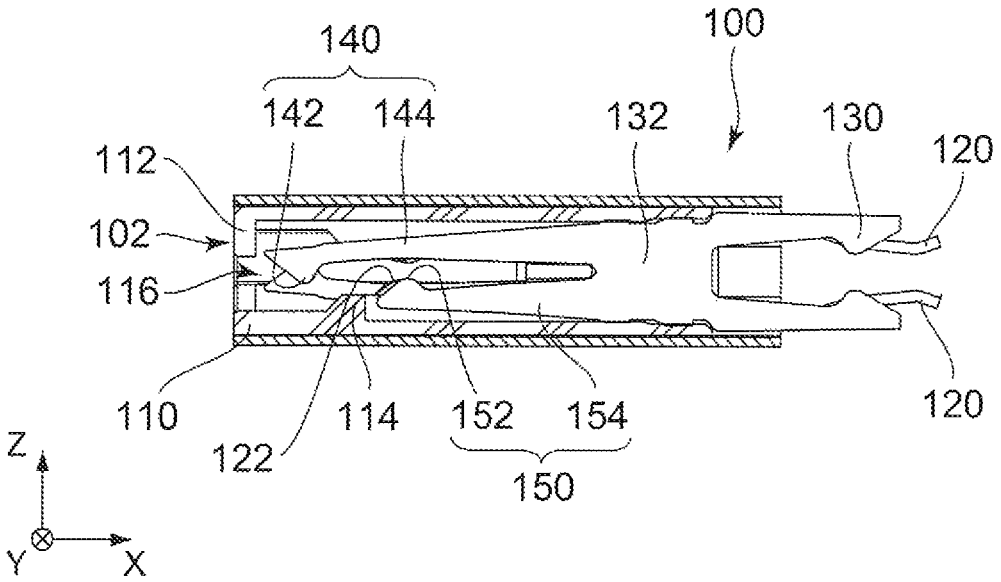
FIG. 10 is a cross-sectional view showing the plug of FIG. 8, taken along line X-X.

As shown in FIGS. 7, 9, 10 and 12, an inside of the plug holding member 110 is formed with a space 116 which is opened at a plug fitting end (fitting end) 102 positioned at an end of the plug 100. As understood from FIG. 12, the space 116 receives the plate portion 214 when the plug 100 is mated with the receptacle 200. As shown in FIGS. 8 and 10, the plug holding member 110 is provided with two kinds of guard portions (i.e. guard portions 112 and guard portions 114). Each of the guard portions 112 and the guard portions 114 protrudes in the space 116 of the plug holding member 110. Each of the guard portions 112 forms a wall which is positioned at a negative X-side end of the plug holding member 110. Each of the guard portions 114 has an elongated, island-like shape which extends long in the Y-direction. Each of the guard portions 112 is positioned beyond each of the guard portions 114 in the negative X-direction.

As understood from FIGS. 1 and 8, the plug signal terminals 120 correspond to the receptacle signal terminals 220, respectively. Similar to the receptacle signal terminals 220, the plug signal terminals 120 are separated into two rows, and the plug signal terminals 120 of each row are arranged in the Y-direction. As shown in FIGS. 8 and 9, each of the plug signal terminals 120 has a signal contact portion 122. Each of the signal contact portions 122 is a portion which is brought into contact with the corresponding receptacle signal terminal 220 when the plug 100 is mated with the receptacle 200. Each of the signal contact portions 122 protrudes in the space 116.

Figure 11:
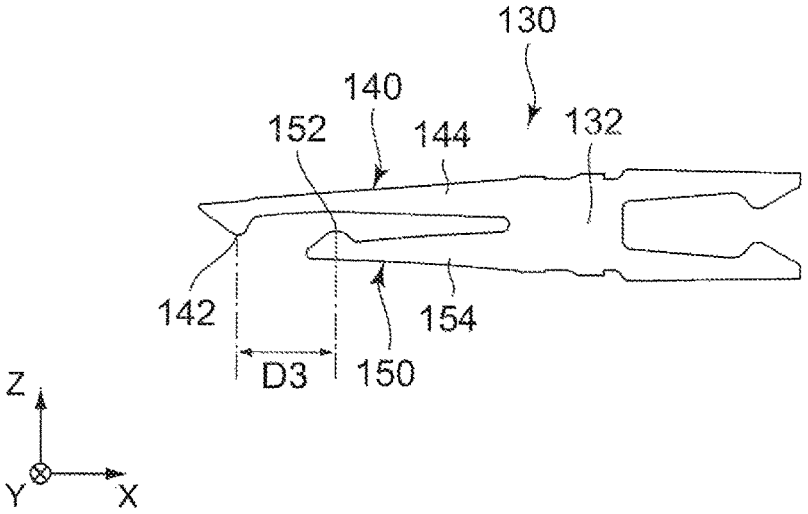
FIG. 11 is a side view showing a ground terminal which is included in the plug of FIG. 8.

As shown in FIG. 11, each of the ground terminals 130 has a fixed portion 132, a first portion 140 and a second portion 150. As shown in FIG. 10, the fixed portion 132 is a portion which is held by and fixed to the holding member 110. As understood from FIGS. 8 to 10 and 12, the ground terminal 130, which is positioned at a positive Y-side of the plug 100, is reversed in the Z-direction relative to the ground terminal 130 which is positioned at a negative Y-side of the plug 100. Hereinafter, explanation will be made about the ground terminal 130 positioned at the negative Y-side of the plug 100. However, about characteristics common to the two ground terminals 130, explanation will be made below by using FIG. 9 in which the ground terminal 130 positioned at the positive Y-side thereof is shown. Explanation about the ground terminal 130 positioned at the positive Y-side of the plug 100 is omitted except for the explanation about the common characteristics.

As shown in FIGS. 10 and 11, the first portion 140 extends from the fixed portion 132 in the negative X-direction. In other words, as shown in FIG. 10, the first portion 140 extends from the fixed portion 132 toward the plug fitting end 102. The first portion 140 has a lock portion 142 and a lock spring portion 144. The lock portion 142 protrudes in the negative Z-direction. The lock spring portion 144 resiliently supports the lock portion 142. The guard portion 112 is positioned beyond the first portion 140 in the negative X-direction. As shown in FIGS. 8 and 10, an end of the first portion 140 is hidden by the guard portion 112 while the lock portion 142 is not hidden by the guard portion 112. Accordingly, when the plug 100 is viewed from the plug fitting end 102, the end of the first portion 140 is invisible while the lock portion 142 is visible. This arrangement can prevents a part of the receptacle 200 (see FIG. 12) from abutting against the end of the first portion 140, so that the first portion 140 can be prevented from being damaged. Thus, the guard portion 112 guards the first portion 140.

Figure 13:
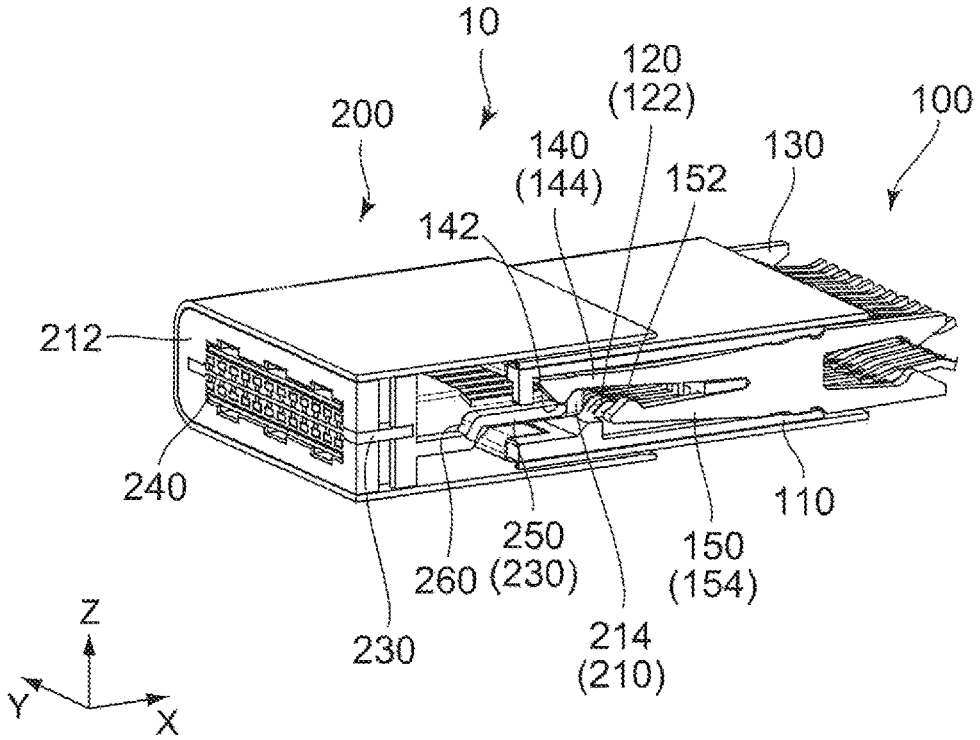
FIG. 13 is a cross-sectional, perspective view showing a state, followed by the state of FIG. 12, in the mating process.
Figure 14:
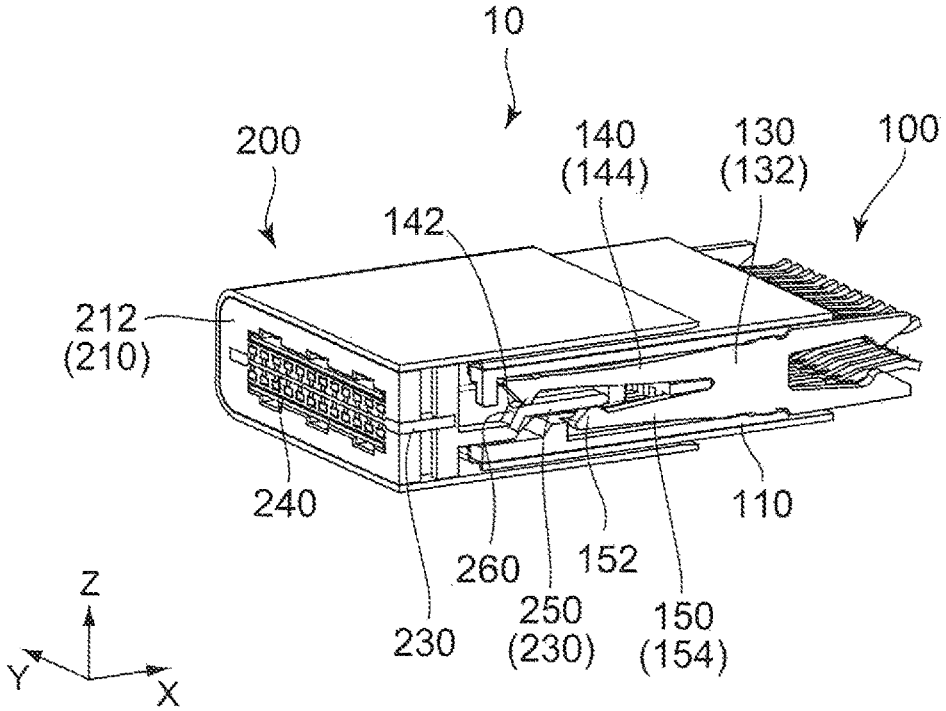
FIG. 14 is a cross-sectional, perspective view showing a state, followed by the state of FIG. 13, in the mating process.
Figure 15:
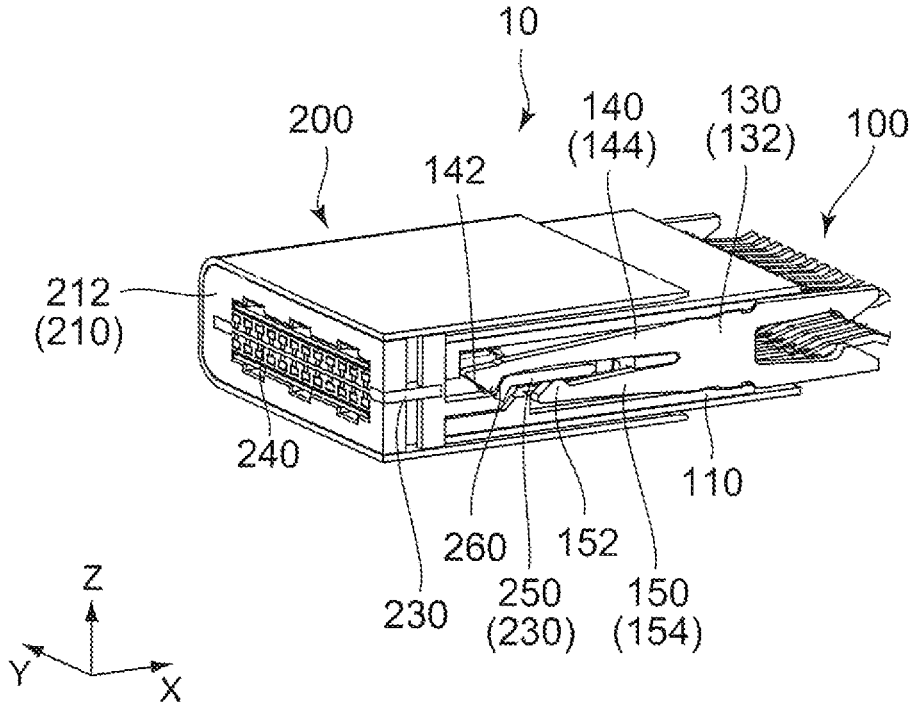
FIG. 15 is a cross-sectional, perspective view showing a state, followed by the state of FIG. 14, in the mating process.
Figure 16:
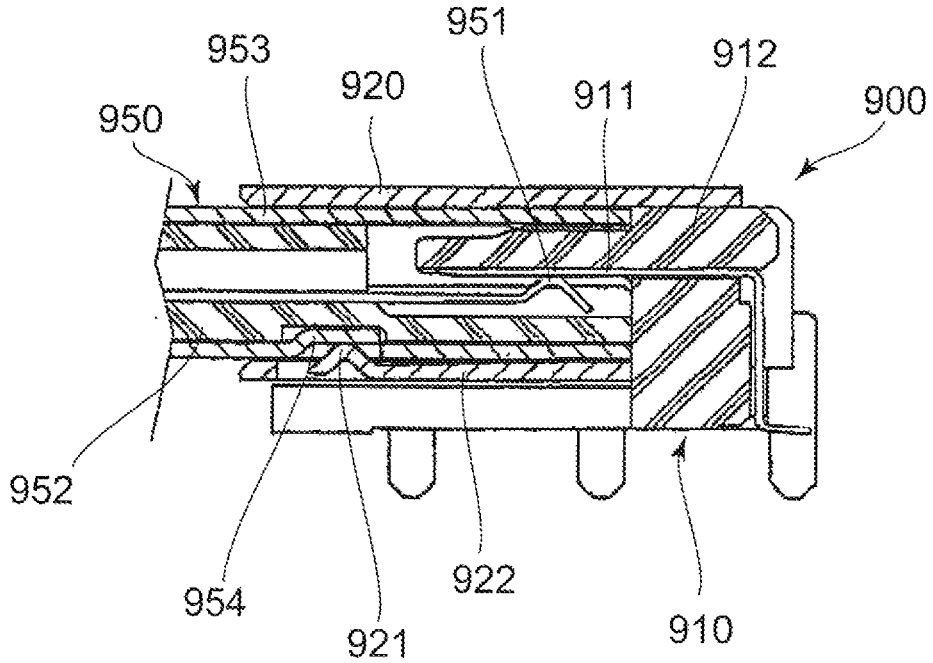
FIG. 16 is a cross-sectional view showing a connector assembly of Patent Document 1.

As shown in FIGS. 13 and 14, the lock portion 142 is brought into contact with a positive Z-side surface of the ground contacted portion 250 in a process where the plug 100 and the receptacle 200 are mated with each other. At that time, contact force of the lock portion 142 is mainly obtained by resilient deformation of the lock spring portion 144. As shown in FIG. 15, under a state where the plug 100 is mated with the receptacle 200, the lock portion 142 enters into a negative X-side of the locked portion 260 to lock the locked portion 260. Thus, frictional locking can be achieved in the present embodiment.

As shown in FIG. 15, under the state where the plug 100 is mated with the receptacle 200, the lock spring portion 144 is not in contact with the ground contacted portion 250. Specifically, the lock spring portion 144 is provided so as not to be brought into contact with the ground contacted portion 250 under a state where the lock portion 142 locks the locked portion 260. In other words, the lock spring portion 144 never obstructs a movement of the lock portion 142 when the lock portion 142 enters into the negative X-side of the locked portion 260, so that the movement of the lock portion 142 can be maximized. Accordingly, a user can strongly feel a click when the plug 100 is mated with the receptacle 200 so that the lock portions 142 lock the locked portions 260, respectively.

Referring to FIG. 9, each of the lock portions 142 is positioned beyond each of the signal contact portions 122 in the negative X-direction. Specifically, each of the lock portions 142 is nearer to the plug fitting end 102 than each of the signal contact portions 122 is, and each of the lock portions 142 is positioned between each of the signal contact portions 122 and the plug fitting end 102. Specifically, each of the signal contact portions 122 is spaced apart from the plug fitting end 102 in the X-direction by a third distance. Each of the lock portions 142 is spaced apart from the plug fitting end 102 in the X-direction by a fourth distance. The third distance is longer than the fourth distance by a second predetermined distance D2.

The second predetermined distance D2 according to the present embodiment is longer than the aforementioned first predetermined distance D1 (see FIG. 2). Thus, as understood from FIGS. 12 and 13, when the plug 100 is mated with the receptacle 200, the lock portions 142 can be brought into contact with the ground contacted portions 250, respectively, before the plug signal terminals 120 are brought into contact with the receptacle signal terminals 220, respectively. In other words, a satisfactory connection sequence can be achieved in the connector assembly 10 of the present embodiment.

As shown in FIGS. 10 and 11, the second portion 150 extends from the fixed portion 132 in the negative X-direction. In other words, as shown in FIG. 10, the second portion 150 extends from the fixed portion 132 toward the plug fitting end 102. As shown in FIGS. 9 and 11, in the X-direction, the second portion 150 is shorter than the first portion 140. Specifically, the lock portion 142 is positioned beyond the ground contact portion 152 in the negative X-direction by a distance D3. In other words, the lock portion 142 and the ground contact portion 152 are spaced apart from each other by the distance D3 in the X-direction.

As shown in FIGS. 10 and 11, the second portion 150 is connected with the first portion 140 through the fixed portion 132. Accordingly, the second portion 150 is electrically connected with the first portion 140. The second portion 150 has a ground contact portion 152 and a ground spring portion 154. The ground contact portion 152 protrudes in the positive Z-direction. The ground spring portion 154 resiliently supports the ground contact portion 152. Specifically, the ground contact portion 152 and the lock portion 142 protrude in orientations different from each other in the Z-direction. The guard portion 114 is positioned beyond the second portion 150 in the negative X-direction. Referring to FIGS. 8 and 10, an end of the second portion 150 is hidden by the guard portion 114. Thus, the end of the second portion 150 is invisible when the plug 100 is viewed from the plug fitting end 102. Meanwhile, the ground contact portion 152 protrudes above the guard portion 114 in the positive Z-direction. Thus, the ground contact portion 152 is contactable while the second portion 150 is guarded thereby.

As shown in FIG. 14, the ground contact portion 152 is brought into contact with a negative Z-side surface of the ground contacted portion 250 in the process where the plug 100 is mated with the receptacle 200. In other words, the ground contact portion 152 is brought into contact with a surface of the ground contacted portion 250 which is opposite to a surface thereof with which the lock portion 142 is brought into contact. At that time, contact force of the ground contact portion 152 is mainly obtained by resilient deformation of the ground spring portion 154. Furthermore, as shown in FIG. 15, the ground contact portion 152 keeps in contact with the ground contacted portion 250 under the state where the plug 100 is mated with the receptacle 200. Accordingly, in the process where the plug 100 is mated with the receptacle 200, the lock portion 142 is brought into contact with the ground contacted portion 250 and then the ground contact portion 152 is successively brought into contact with the ground contacted portion 250 without the lock portion 142 being left in contact with the ground contacted portion 250. In other words, in the present embodiment, the ground contacted portions 250 can be continuously connected to the ground in the process where the plug 100 and the receptacle 200 are mated with each other. Thus, the connector assembly of the present invention has a high resistance to EMI. In the present embodiment, the distance D3 (see FIGS. 9 and 11) between the lock portion 142 and the ground contact portion 152 in the X-direction is shorter than the length L (see FIG. 5) of the ground contacted portion 250 in the X-direction in order to ensure the aforementioned continuous grounding.

Since the ground contact portion 152 is positioned beyond the lock portion 142 in the positive X-direction, a contact point at which the ground contact portion 152 and the ground contacted portion 250 are in contact with each other is nearer to the receptacle fitting end 202 than the lock portion 142 is under the state where the plug 100 is mated with the receptacle 200. Accordingly, an appropriate grounding path can be established therebetween.

Although the above explanation is made specifically with the embodiment of the present invention, the present invention is not limited thereto. The present invention can be variously modified.

In the aforementioned embodiment, the plug signal terminals 120 are arranged in the two rows, and the receptacle signal terminals 220 are arranged in the two rows. However, for example, the plug signal terminals 120 may be arranged in one row, and the receptacle signal terminals 220 may be arranged in one row.

Although the first portion 140 and the second portion 150 are connected and integrated with each other by the fixed portion 132, the present invention is not limited thereto. For example, the first portion 140 and the second portion 150 may be formed separately from each other. In this case, it is, however, necessary for the first portion 140 and the second portion 150 to be at least electrically connected with each other in order to form a continuous ground connection.

As understood from the aforementioned description that the first portion 140 and the second portion 150 may be formed separately with each other, each of the first portion 140 and the second portion 150 is formed with an independent contact point dissimilar to a tuning fork contact. Accordingly, for example, the ground contact portion 152 never receives a force toward the positive Z-direction when the lock portion 142 is moved in the positive Z-direction.

Although the ground member 230 of the aforementioned embodiment is formed of a single member, the ground member 230 may be formed of two or more members.

Although the plug 100 of the aforementioned embodiment is not provided with a ground plate, the plug 100 may be provided with a ground plate, and the ground plate may be connected with the ground terminals 130.

The present application is based on a Japanese patent application of JP2014-097041 filed before the Japan Patent Office on May 8, 2014 the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 connector assembly
100 plug (connector)
102 plug fitting end (fitting end)
110 plug holding member (holding member)
112 guard portion
114 guard portion
116 space
120 plug signal terminal
122 signal contact portion
130 ground terminal
132 fixed portion
140 first portion
142 lock portion
144 lock spring portion
150 second portion
152 ground contact portion
154 ground spring portion
160 plug shell
200 receptacle (mating connector)
202 receptacle fitting end (mating fitting end)
210 receptacle holding member (mating holding member)
212 base portion
214 plate portion
220 receptacle signal terminal mating signal terminal)
230 ground member
240 ground main portion
250 ground contacted portion
260 locked portion
270 receptacle shell
900 connector assembly
910 connector
911 signal terminal
912 holding member
920 shell
921 lock portion
922 lock spring portion
950 mating connector
951 mating signal terminal
952 mating holding member
953 mating shell
954 locked portion

The invention claimed is:

1. A connector mateable with a mating connector along a predetermined direction, wherein:

the mating connector has a mating fitting end;

the mating fitting end is positioned at an end of the mating connector in the predetermined direction;

the mating connector comprises a ground member and a mating signal terminal;

the ground member has a ground contacted portion and a locked portion;

the ground contacted portion is positioned between the locked portion and the mating fitting end in the predetermined direction;

the connector has a fitting end;

the fitting end is positioned at an end of the connector in the predetermined direction;

the connector comprises a first portion, a second portion and a signal terminal;

the first portion has a lock portion and a lock spring portion;

the lock spring portion resiliently supports the lock portion;

the lock portion is brought into contact with the ground contacted portion in a process where the connector and the mating connector are mated with each other;

the lock portion locks the locked portion under a state where the connector is mated with the mating connector;

the second portion is at least electrically connected with the first portion;

the second portion has a ground contact portion and a ground spring portion;

the ground spring portion resiliently supports the ground contact portion;

the ground contact portion is brought into contact with the ground contacted portion under the state where the connector is mated with the mating connector;

the lock portion is positioned between the fitting end and the ground contact portion in the predetermined direction;

the signal terminal has a signal contact portion; and the signal contact portion is to be brought into contact with the mating signal terminal.

2. The connector as recited in claim 1, wherein:

the mating signal terminal is spaced apart from the mating fitting end in the predetermined direction by a first distance;

the ground contacted portion is spaced apart from the mating fitting end in the predetermined direction by a second distance;

the first distance is shorter than the second distance by a first predetermined distance;

the signal contact portion is spaced apart from the fitting end in the predetermined direction by a third distance;

the lock portion is spaced apart from the fitting end in the predetermined direction by a fourth distance;

the third distance is longer than the fourth distance by a second predetermined distance; and the second predetermined distance is longer than the first predetermined distance.

3. The connector as recited in claim 1, wherein:

the lock portion is spaced apart from the ground contact portion in the predetermined direction by a fifth distance;

the ground contacted portion has a first length in the predetermined direction; and the fifth distance is shorter than the first length.

4. The connector as recited in claim 1, wherein the first portion and the second portion are formed integrally with each other.

5. The connector as recited in claim 1, wherein the lock portion and the ground contact portion protrude in orientations different from each other in a perpendicular direction perpendicular to the predetermined direction.

6. The connector as recited in claim 1, wherein the lock spring portion is provided so as not to be brought into contact with the ground contacted portion under a state where the lock portion locks the locked portion.

7. A connector assembly comprising the connector as recited in claim 1 and the mating connector.

8. The connector assembly as recited in claim 7, wherein:

the ground contacted portion of the mating connector extends in the predetermined direction; and the locked portion extends from the ground contacted portion in a direction intersecting with the predetermined direction.

9. The connector assembly as recited in claim 7, wherein:

the mating connector comprises a mating holding member;

the mating holding member has a plate portion;

the mating signal terminal is held by the mating holding member so as to be exposed on the plate portion;

the ground member has a ground main portion having a plate-like shape; and the ground main portion is held by the plate portion so as to be insulated from the mating signal terminal.

* * * * *